US008074294B2

(12) United States Patent
Bowlus et al.

(10) Patent No.: US 8,074,294 B2
(45) Date of Patent: Dec. 13, 2011

(54) WEARABLE SPINAL PROTECTIVE APPARATUS

(75) Inventors: Larry Richard Bowlus, Anchorage, AK (US); Heidi Marie Bowlus, Anchorage, AK (US); James Brian Szender, Omaha, NE (US)

(73) Assignee: Larry R. Bowlus, Anchorage, AL (US)

( * ) Notice: Subject to any disclaimer, the term of this patent is extended or adjusted under 35 U.S.C. 154(b) by 464 days.

(21) Appl. No.: 12/313,004

(22) Filed: Nov. 17, 2008

(65) Prior Publication Data

US 2010/0122404 A1 May 20, 2010

(51) Int. Cl.
*A41D 13/00* (2006.01)

(52) U.S. Cl. ..... 2/44

(58) Field of Classification Search ..... 2/455, 467, 2/44, 69, 92, 93, 267, 115, 102, 108, 45; 602/19, 20; 128/870, 874, 846, 869, 873, 128/99.1, 100.1

See application file for complete search history.

(56) References Cited

U.S. PATENT DOCUMENTS 4,338,685 A * 7/1982 LaPorta, Jr. ..... 2/462
4,680,812 A * 7/1987 Weigl ..... 2/467
5,123,408 A * 6/1992 Gaines ..... 602/17
5,140,995 A * 8/1992 Uhl ..... 128/846
5,328,447 A * 7/1994 Kapounek et al. ..... 602/19
5,400,801 A * 3/1995 Archer, III ..... 128/846
5,444,870 A * 8/1995 Pinsen ..... 2/461
5,477,558 A * 12/1995 Volker et al. ..... 2/461
5,517,699 A * 5/1996 Abraham, II ..... 2/425
5,546,601 A * 8/1996 Abeyta ..... 2/468
5,768,717 A * 6/1998 Le Sueur ..... 2/467
6,427,695 B1 * 8/2002 Zanetti et al. ..... 128/846
6,434,756 B1 * 8/2002 Hoop ..... 2/425
6,687,920 B2 * 2/2004 Berns ..... 2/467
6,748,601 B2 * 6/2004 LaShoto et al. ..... 2/102
6,852,087 B1 * 2/2005 Dainese ..... 602/19
7,299,507 B1 * 11/2007 Hermoso et al. ..... 2/467
7,329,230 B2 * 2/2008 Mazzarolo ..... 602/19

* cited by examiner

*Primary Examiner* — Tejash Patel

(57) ABSTRACT

A wearable spinal protective apparatus is presented which will protect all parts of the human spinal column from cervical to lumbosacral vertebrae during high velocity activities. The apparatus is worn by user to cover the entire backside from neck and shoulders down, to be secured around the hips. This apparatus has many sections each uniquely designed to work together to reduce all forms of spinal injury. Protection provided by this apparatus is most valuable during high velocity activities. Because of its unique sectional design this apparatus can be tailored to match any size individual and any level of protection desired. The design of this apparatus goes well beyond the prior art of simple hard shell and padding.

5 Claims, 13 Drawing Sheets

WEARABLE SPINAL PROTECTIVE APPARATUS

CROSS-REFERENCE TO RELATED APPLICATIONS

CURRENT INTERNATIONAL CLASS: A41D 13/05 (20060101); A42B 3/04 (20060101); A63B 71/12 (20060101); A63B 71/08 (20060101); A63B 71/10 (20060101)
CURRENT U.S. CLASS: 2/468; 2/467; 2/421; 2/425; 2/462; 2/455; 2/92; 128/846, 2/468, 2/410, 2/44, 2/92, 2/909, 2/459,461,463,602/17; 602/18, 602/61, 2/2,
FIELD OF SEARCH: 128/846, 2/425, 410, 424, 422, 468, 411, 421, 462, 415, 459, 461, 463, 467, 92, 909, 602/17, 18,

REFERENCES CITED

U.S. Pat. No. 4,338,685 July 1982 LaPorta, Jr.
U.S. Pat. No. 4,680,812 July 1987 Weigl
U.S. Pat. No. 5,123,408 June 1992 Gaines
U.S. Pat. No. 5,140,995 August 1992 Uhl
U.S. Pat. No. 5,328,447 July 1994 Kapounek
U.S. Pat. No. 5,400,801 March 1995 Archer III
U.S. Pat. No. 5,444,870 August 1995 Pinsen
U.S. Pat. No. 5,477,558 December 1995 Volker et al.
U.S. Pat. No. 5,517,699 May 1996 Abraham, 11
U.S. Pat. No. 5,546,601 August 1996 Abeyta
U.S. Pat. No. 5,768,717 June 1998 LeSueur
U.S. Pat. No. 6,434,756 August 2002 Hoop
U.S. Pat. No. 6,687,920 February 2004 Berns
U.S. Pat. No. 6,852,087 February 2005 Dainese
U.S. Pat. No. 7,299,507 November 2007 Hermoso et al.
U.S. Pat. No. 7,329,230 February 2008 Mazzarolo This invention is not the result of any federally sponsored research.

BACKGROUND OF THE INVENTION

1. Technical Field

This invention relates to wearable spinal protective devices. Prior art mostly relies on simple padding and hard shell coverings to disperse impact energy; also most are designed to protect small regions of the back or spine. No prior art had the ability to protect the entire spinal column. Our design will provide complete coverage along the entire length of the spinal column, from cervical to lumbosacral vertebrae. In particular it is designed to reduce or prevent all forms of spinal cord trauma that can occur during high velocity activities. Injuries such; as but not limited to: neck whiplash, cervical compression, blunt force trauma, and hyperextension and spinal twisting.

2. Background Art

Many human activities depend on high velocity performance such as: motorcycles, ATVs, snow machines, mountain biking, skate boarding, bull riding, and snow skiing. With higher velocities come higher impact forces. These forces during an accident will impact the spinal column in a destructive ways causing debilitating injury. It is estimated that 10,000 people incur Spinal Cord Injury (SCI) every year. This causes untold pain and suffering that lasts a life time, costing tax payers hundreds of millions of dollars. Many inventions exist to deal with some aspect of spinal column protection, but the numbers of SCI cases still grow. This proves these prior devices aren't providing complete protection. The lack of protection is because these past inventions routinely rely on simple padding covered by a hard shell in an attempt to disperse impact forces. More importantly they are routinely designed to protect only one area of the spinal column from possible injury. Although by different design and mechanical means most provide the same level of inadequate protection. Our present invention approaches the spinal safety issue differently; it is to have one wearable spinal protective apparatus that brings together all the different aspects of injury prevention for the spinal column in one apparatus for complete spinal coverage. The present invention will provide during an accident situation; protection to the neck to reduce the forces the cause whiplash, side angle whiplash, neck compression, spinal twisting, blunt force trauma and upon a rear collision a rigid back structure between the skull and the pelvis.

DESCRIPTION PRIOR ART

A protective device for the spinal column is known and has many design configurations, for example U.S. Pat. No. 4,680,812 issued Jul. 21, 1987 to Weigl. This protective device utilizes padding and overlapping plates connected by a single pivot point, it covers from the lower spine to the upper back area, it also claims to impede over bending the spine in a backward direction. However, this design does not provide total spinal column coverage or coverage of the cervical spine or shoulders and it does not address spinal compression or twisting of the spine and the blunt force trauma protection would be minimal.

Another example is U.S. Pat. No. 5,140,995 issued Aug. 25, 1992 to Uhl. This protective device utilizes padding and overlapping elements with hollow spaces fastened to a long flexible member positioned over some portion of the spine, it covers from the lower spine to the upper back area. However, this design does not provide total spinal column coverage or coverage of the cervical spine or shoulders and it does not address spinal compression or hyperextension or twisting of the spine and the blunt force trauma protection would be minimal.

Another example is U.S. Pat. No. 5,328,447 issued Jul. 12, 1994 to Kapounek et al. This protective device utilizes padding and overlapping elongated support members held in relationship by a joint formed hollow area then a protrusion on next section, it covers from the lower spine to the upper back area, also it shows a soft pad to wrap over the shoulders to help support the device. However, this design does not provide total spinal column coverage or coverage of the cervical spine or shoulders and it does not address spinal compression or hyperextension or twisting of the spine and the blunt force trauma protection would be minimal.

Another example is U.S. Pat. No. 5,400,801 issued Mar. 28, 1995 to Archer, III. This protective device utilizes padding and interlocking curved members held in relationship by mechanical means, it protects from the lower spine to the upper back area, also it clearly states it purpose is to mitigate injury due to impact. However, this design does not provide total spinal column coverage or coverage of the cervical spine or shoulders and it does not address spinal compression or hyperextension or twisting of the spine and the blunt force trauma protection would be minimal.

Another example is U.S. Pat. No. 5,768,717 issued Jun. 23, 1998 to Le Sueur. This protective device utilizes padding and overlapping elongate segmented members with curved edges mounted on a resilient base material held in relationship by a tight fitting garment with a long pocket to hold segmented members close to the body, it covers the lower spine to the upper back area, However this design does not provide total spinal column coverage or coverage of the cervical spine or shoulders and it does not address spinal compression or hyperextension or twisting of the spine and the blunt force trauma protection would be minimal.

Another example is U.S. Pat. No. 6,687,920 B2 issued Feb. 10, 2004 to Berns. This protective device utilizes padding and with a plastic wing extending to ether side of a center line support member held in relationship by a mechanical means and a long soft pad, it covers the lower spine to the upper back area and requires a jacket to be held in place. However this design does not provide total spinal column coverage or coverage of the cervical spine or shoulders and it does not address spinal compression or hyperextension or twisting of the spine and the blunt force trauma protection would be minimal.

Another example is U.S. Pat. No. 6,852,087 B1 issued Feb. 8, 2005 to Dainese. This protective device utilizes padding and plurality of substantially rigid plates having strengthening grid of ribs fixed by a pin and hinge element members held in relationship by a mechanical means, It is designed in particular for motorcyclist and it covers the lower spine to the upper back area and requires a strap and waste belt to be held in place. Also this system is not very flexible and opposes sideways lateral flexing of the trunk. However this design does not provide total spinal column coverage or coverage of the cervical spine or shoulders and it does not address spinal compression, and claims moderate rearward bending prevention.

Yet another example is U.S. Pat. No. 7,329,230 B2 issued Feb. 12, 2008 to Mazzarolo. This protective device utilizes padding and with plastic shield and a plurality of plates which are hinged together held in relationship by a mechanical flexible hinge means, it covers the lower spine to the upper back area and requires a straps or belts to be held in place. However this design does not provide total spinal column coverage or coverage of the cervical spine or shoulders and it does not address spinal compression or hyperextension or twisting of the spine and the blunt force trauma protection would be minimal.

BRIEF SUMMARY OF THE INVENTION

The present invention advances the art of wearable spinal protection devices, with special emphasis on the entire spine being protected during high velocity activities. The invention includes superior design engineering that goes well beyond simple padding and hard shell coverings alone for back and spinal protection. In accordance with this invention, this apparatus will be sized to accommodate the body size of the wearer. New design engineering features are introduced never seen in any prior art of this field of invention such as the 'Z'-shingle flexible beam a preferred embodiment of this invention and the load tension strap that will prevent hyperextension of the spine, the lumbar lateral joint another preferred embodiment of this invention, allowing natural side to side movement with out loss of protection also the slide extender and holster, yet another preferred embodiment of this invention, which accommodates the natural elongation phenomena the spinal column displays when it bends forward without loss of protection. These new design features represent the most advanced engineering to date that will prevent spinal hyperextension, whiplash, axial neck compression and blunt force trauma.

BRIEF DESCRIPTION OF THE DRAWINGS

For a full appreciation of the objects of this invention to be clearly understood and the advancement in the art of the field of this invention be made obvious we will fully describe them in the following drawings.

DETAILED DESCRIPTION OF THE INVENTION

The preferred embodiment of this invention relates to a wearable spinal protection device, this device or apparatus protects the wearer in all ways that corresponds to the major causes of spinal injury that can result in accidents at high velocity activities. This wearable spinal protection apparatus protects against blunt force trauma the full length of the spinal column from cervical to lumbosacral vertebrae. This wearable spinal protection apparatus protects against all forms of hyperextension of the spinal column. This wearable spinal protection apparatus protects against axial compression of the cervical spine region of the neck. This wearable spinal protection apparatus protects against whiplash of the neck. This wearable spinal protection apparatus protects against side angle whiplash of the neck. This wearable spinal protection apparatus protects against twisting injuries of the spinal column. This wearable spinal protection apparatus has advantages that will be most realized during high velocity or high impact activities such as sports events involving motor cycles, ATV's, snow machines, mountain bikes, snowboards, horse riding, or bull riding. The following drawings are presented to more fully explain this invention and the new engineering designs which represent new art and are considered part of the specifications.

Figure 1:
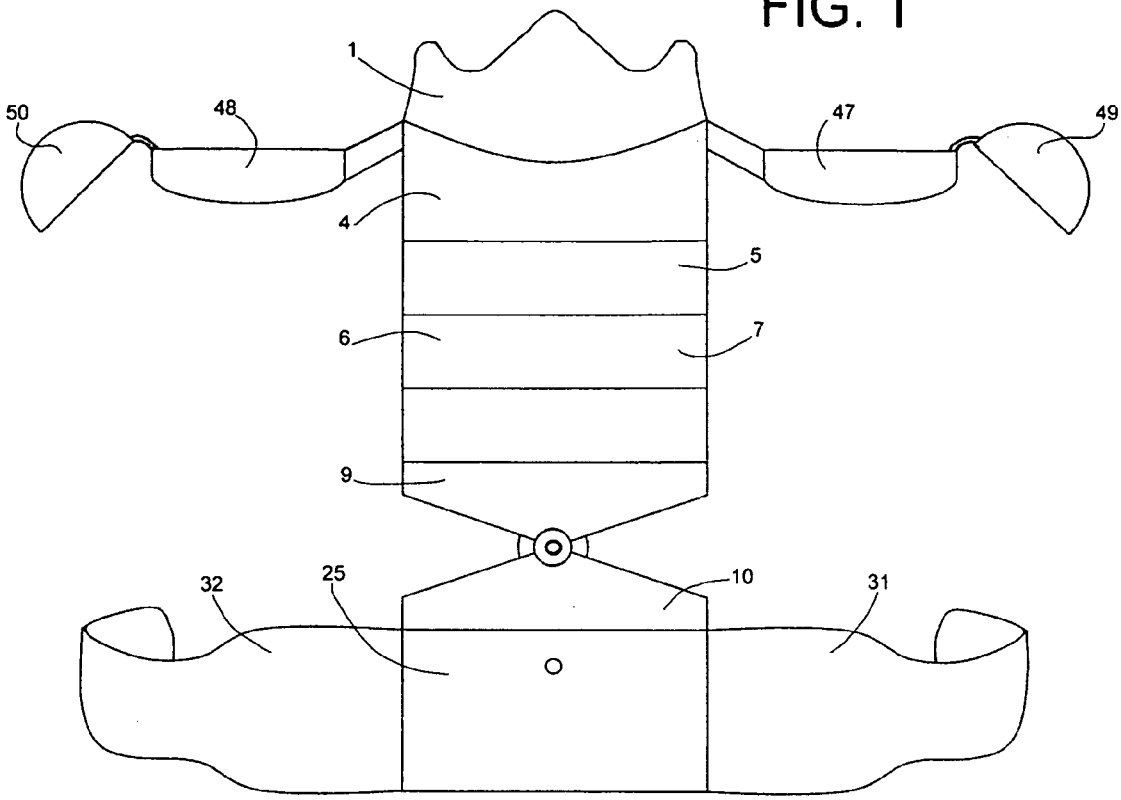
FIG. 1 is a rear angled view which clearly shows all major structures that comprise this apparatus and it full coverage capabilities.
Figure 8:
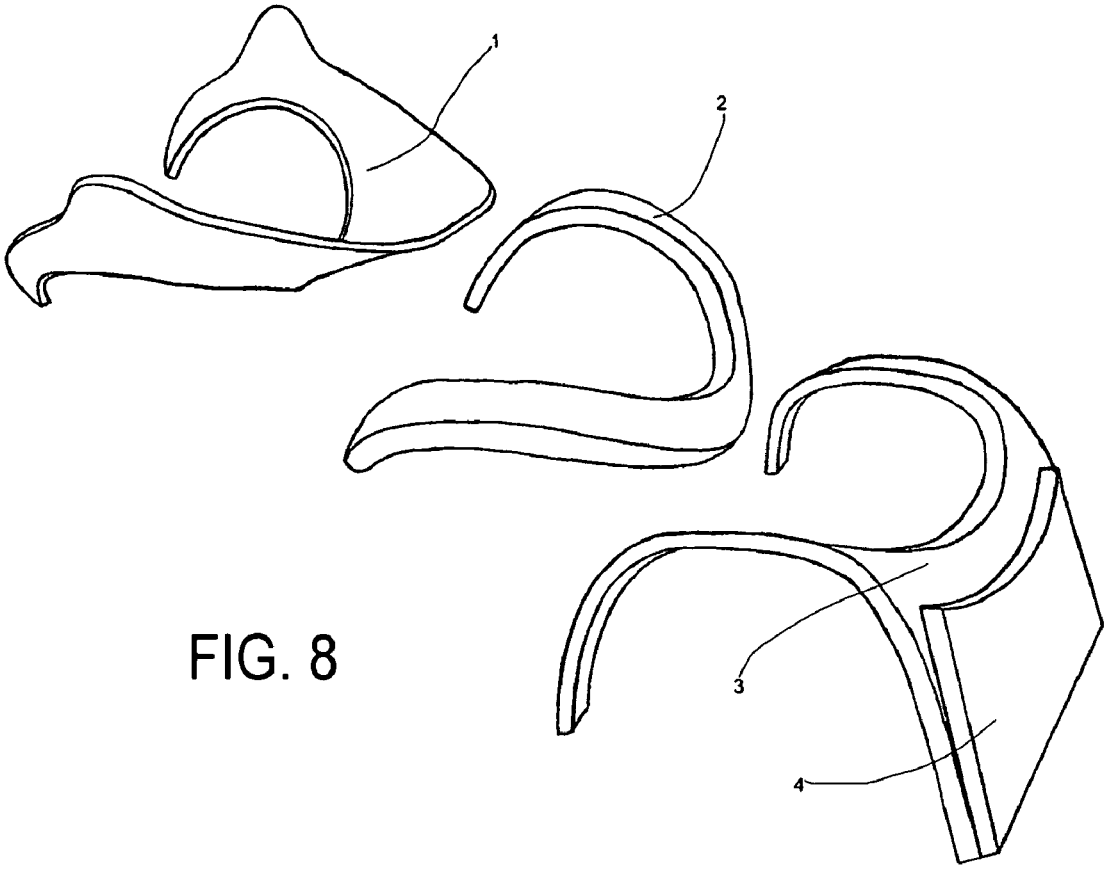
FIG. 8 show an exploded view of the collar, anti-compression neck ring and shoulder roll.
Figure 9:
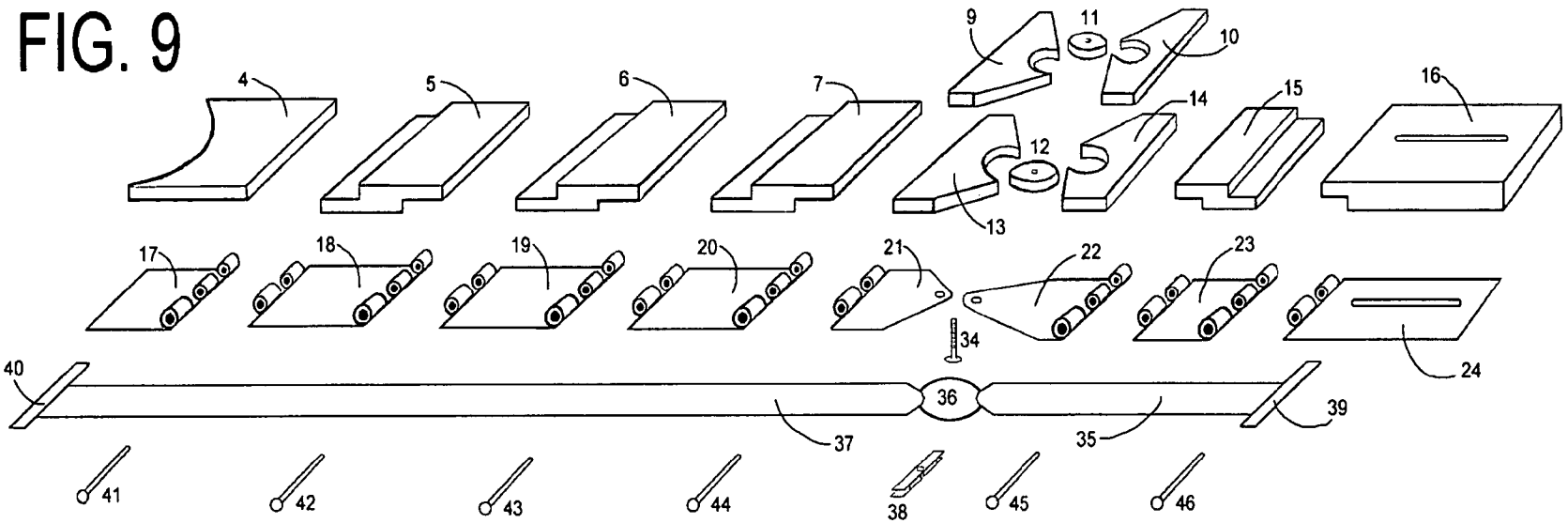
FIG. 9 shows a exploded view of the entire "Z"-shingle flexible beam with the lumbar lateral joint that allows bending side to side with no loss of protection.
Figure 11:
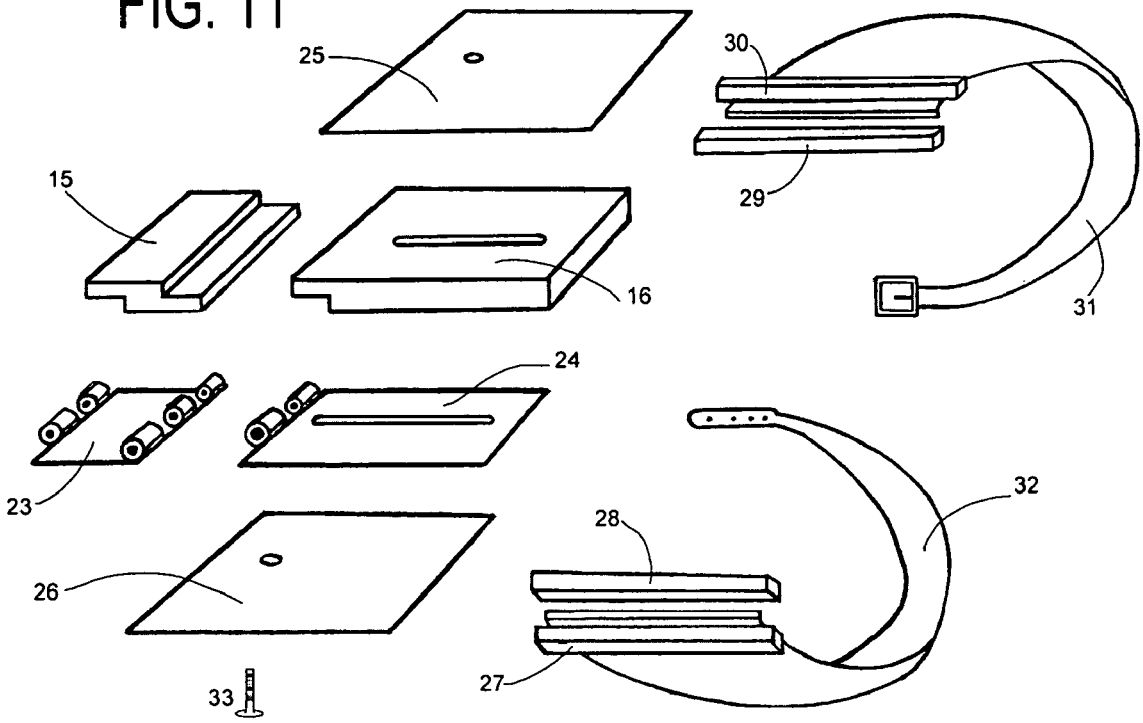
FIG. 11 shows exploded view of the slide extender with holster and belt assembly, which allows the apparatus to accommodate spinal elongation as wearer bends forward.
Figure 13:
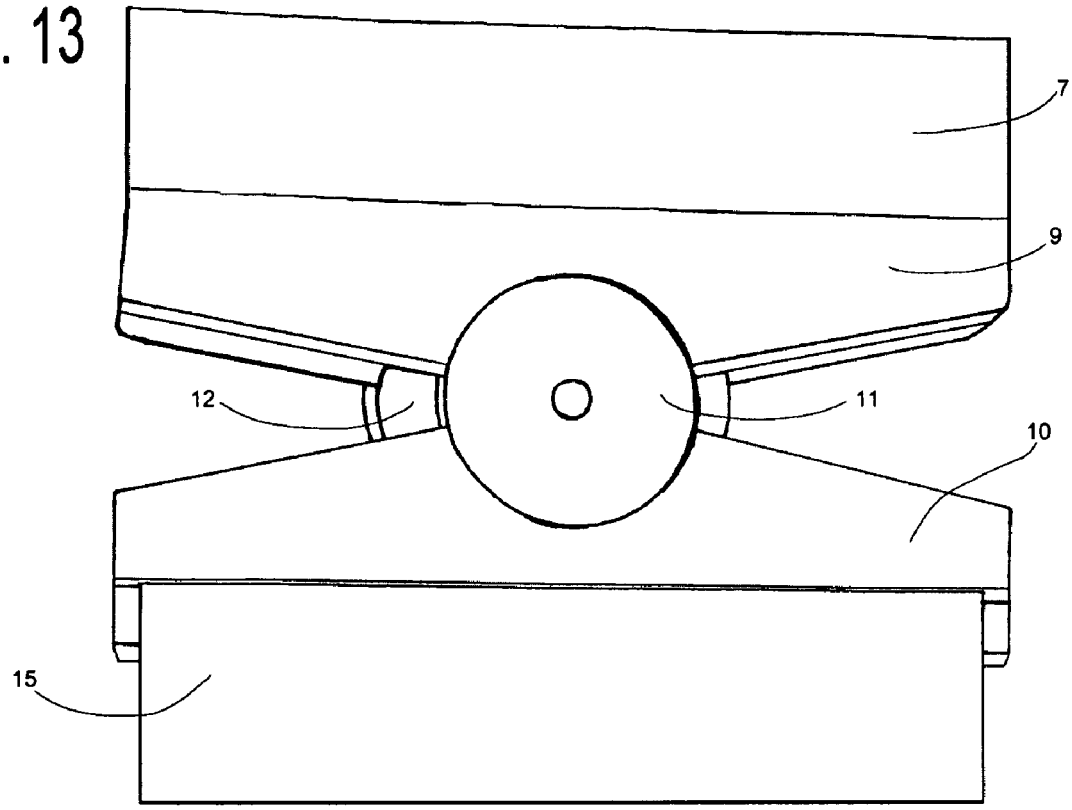
FIG. 13 shows the lumber lateral joint.

As is illustrated in FIG. 1, this wearable spinal protection apparatus is shown in a rear view that shows the complete apparatus and most of its major components with the shirt garment removed; 1 is the helmet collar the spoon like protrusions function to limit the motion of the helmet and therefore reduce whiplash injuries and will be more fully described in FIG. 8, 25 is the slide extender unit which will allow the 'Z'-shingle flexible beam to elongate without loss of strength, protection or comfort to the wearer, the slide extender will be fully described in FIG. 11. 32, 31 are the hip belt sections these fit snugly around the hips of the wearer to anchor this safety apparatus at the base of the spinal column, 50, 48, 47, 49 are the shoulder protectors, these are made of rigid material and are attached to the shoulder roll 3, by soft strapping material and therefore float on the shoulders also they are attached to the shirt garment, 9, 10 is the lateral lumbar joint which allows the spine to flex side to side in a natural way the lateral lumbar joint will be described fully in FIG. 13 and FIG. 9.

Figure 2:
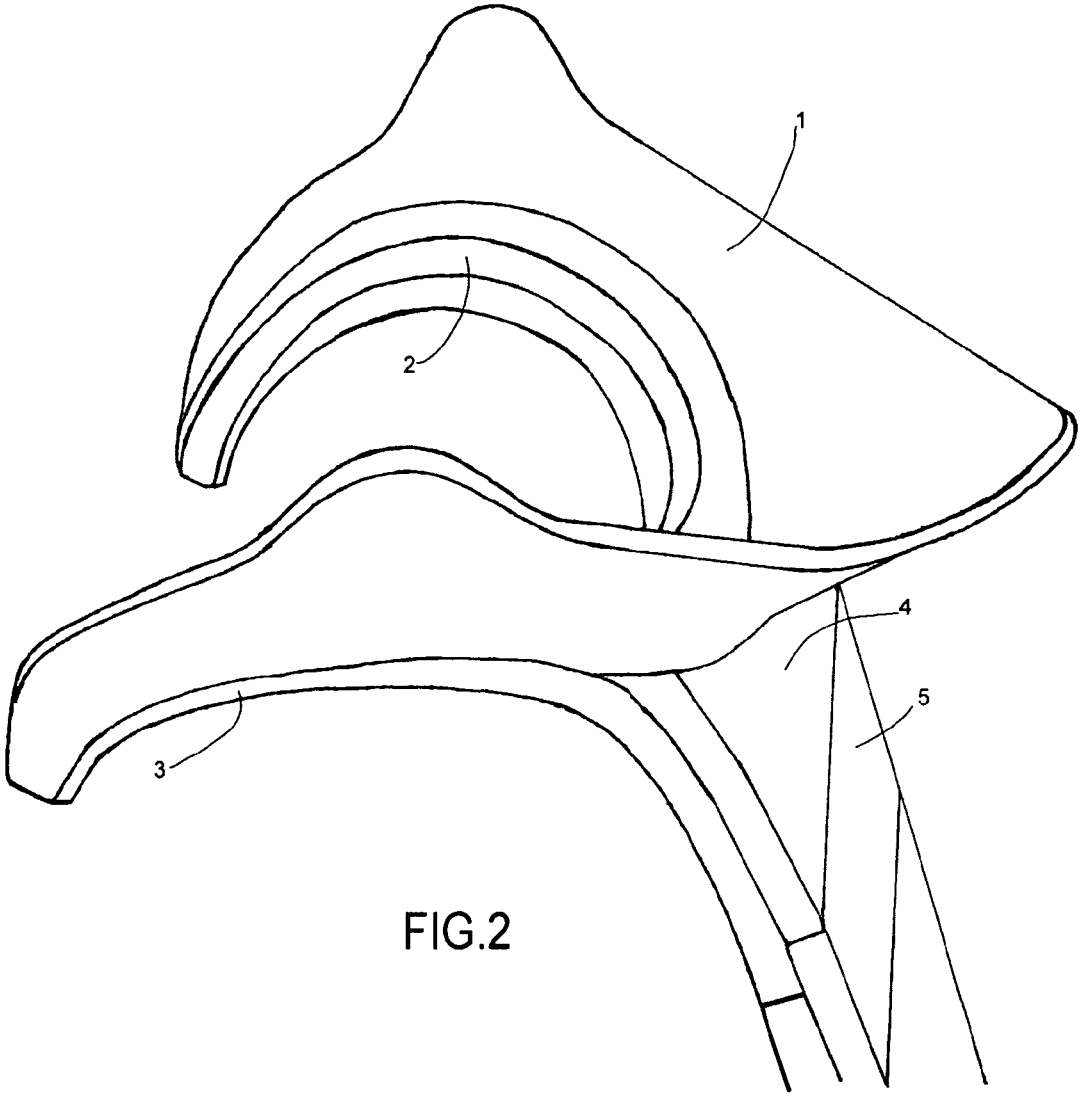
FIG. 2 shows shoulder roll and collar as a structural foundation which anchors the flexible beam.

FIG. 2 is side angle view of the upper portion this wearable spinal protection apparatus made up of 1, 3, 4, 5, 6 which clearly shows the close fitting nature of the shoulder roll and collar as well as the spoon like protrusions. The collar can be molded to accommodate the size of the wearer and adjusted to any level of protection by making spoons larger; also the increasing flare of the molded collar 1 serves to funnel or direct the helmet downward to the anti-compression neck ring 2, displayed.

Figure 3:
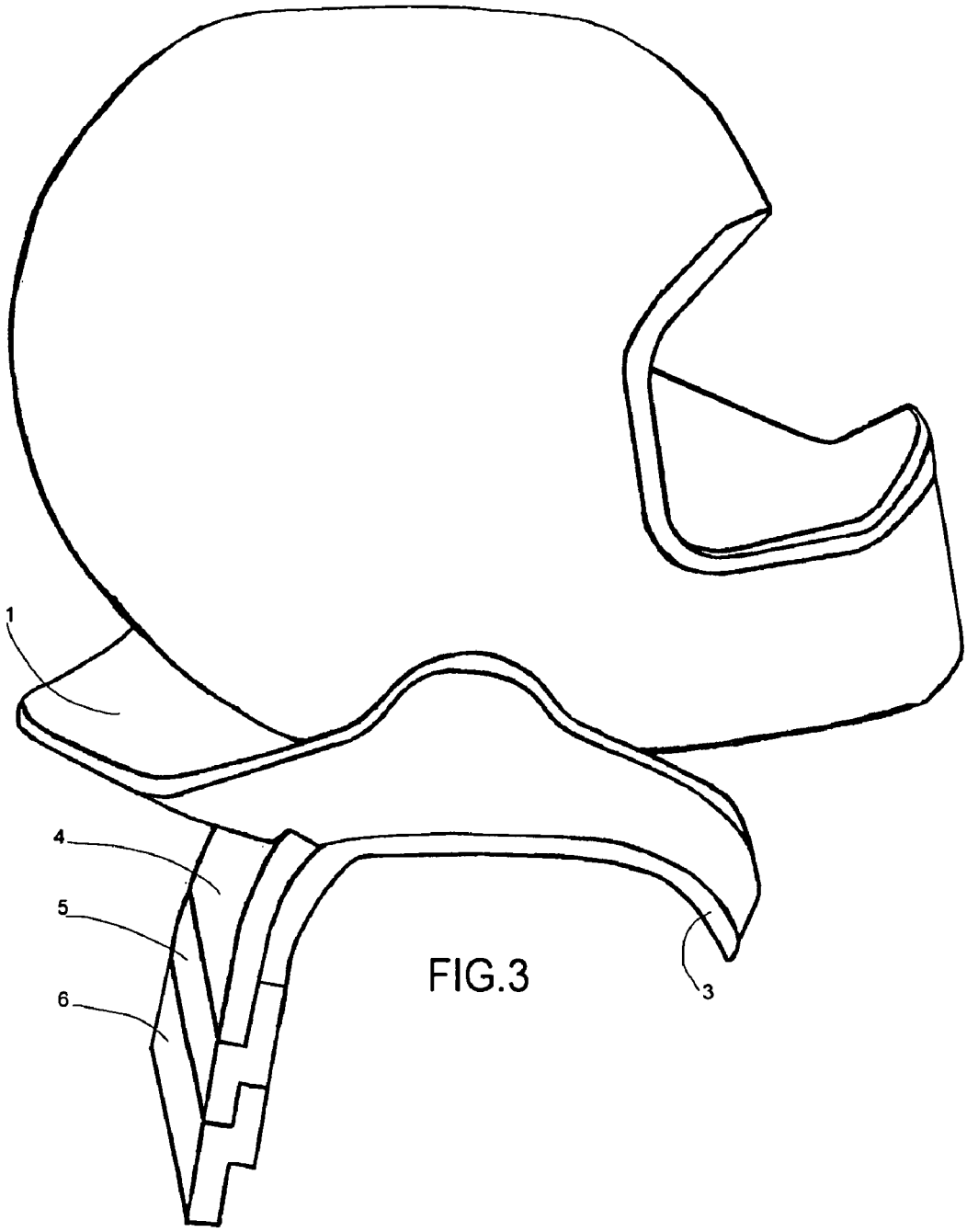
FIG. 3 shows helmet movement in relation to collar
Figure 4:
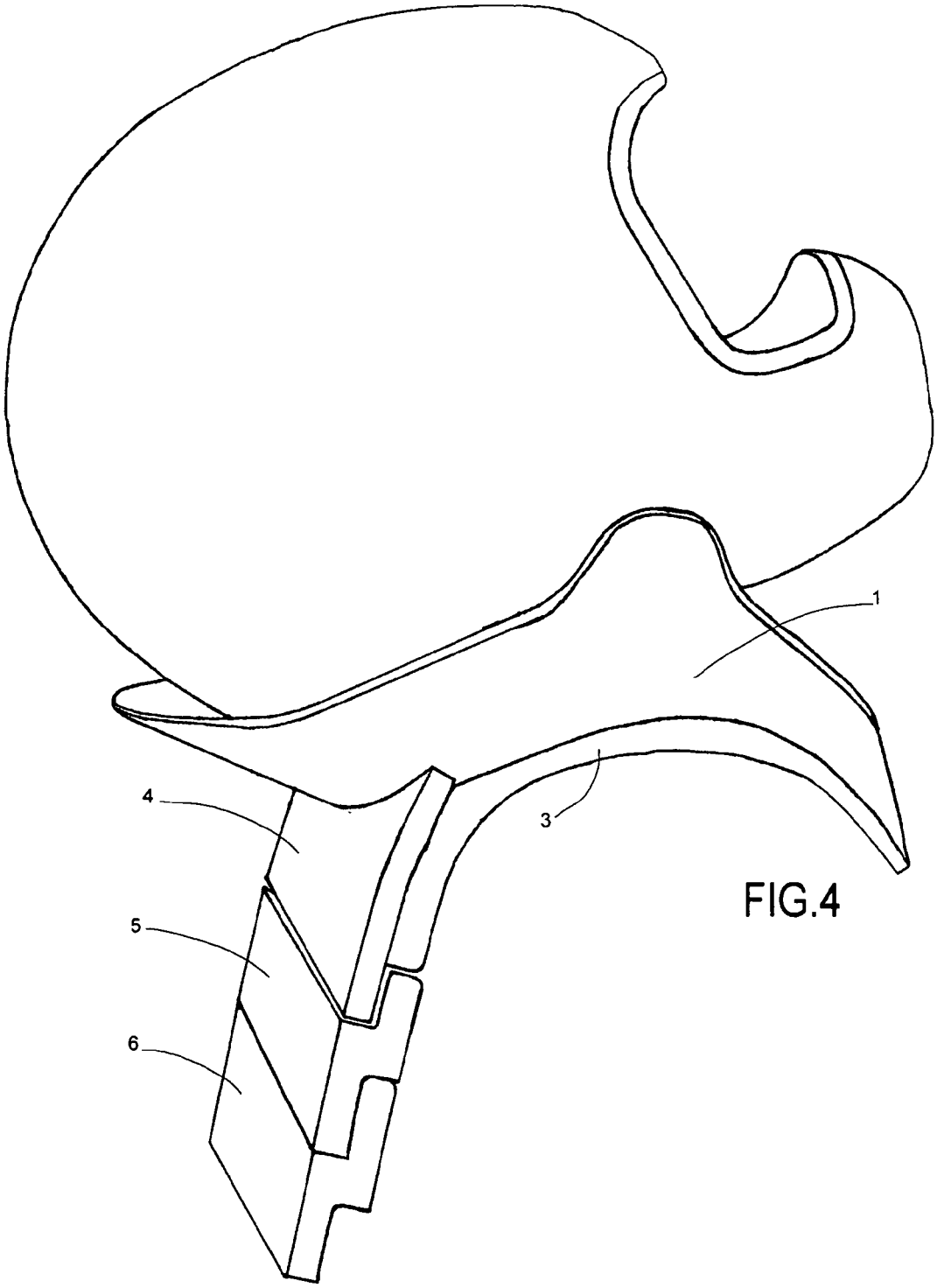
FIG. 4 shows another view of helmet movement and the collar
Figure 5:
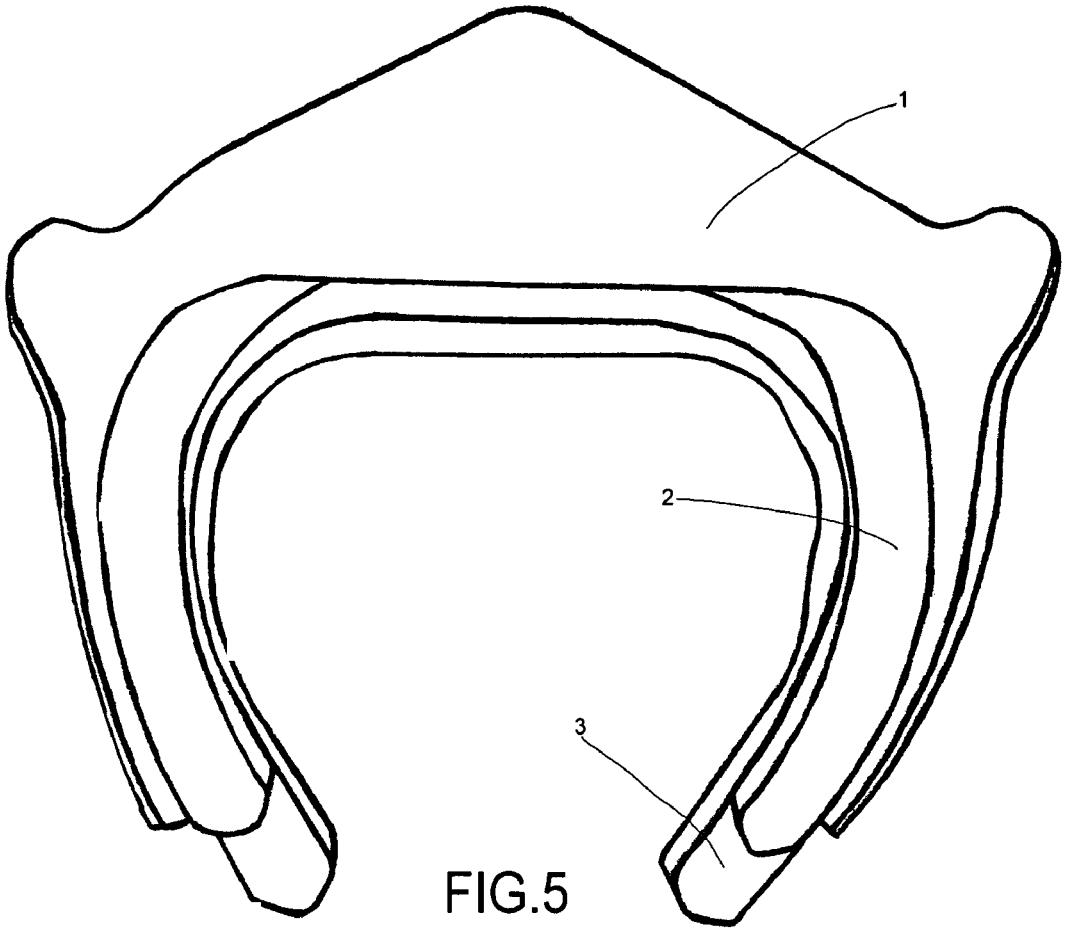
FIG. 5 shows collar, anti-compression neck ring and portion of the shoulder roll it also shows how collar flares will funnel the helmet down to the anti-compression neck ring.
Figure 10:
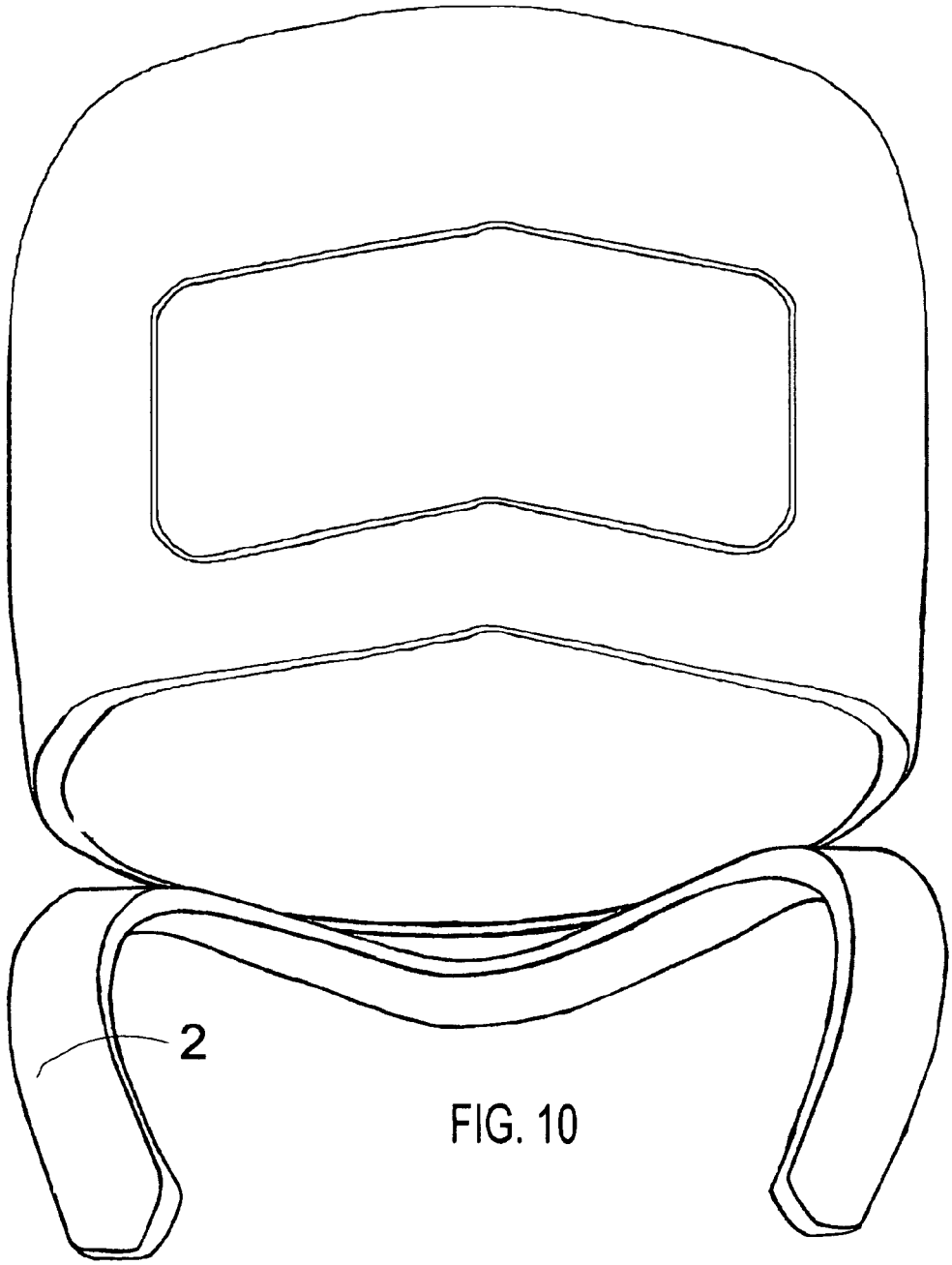
FIG. 10 shows an isolated view of the anti-compression neck ring and the close fitting relationship to a standard full coverage helmet, they match each other.

FIG. 3 and FIG. 4 shows likely movement of a helmeted head and how the collar 1 will limit its range of motion, thus protecting the neck from whiplash and side angle whiplash injuries. FIG. 5 and FIG. 10 clearly show the anti-compression neck ring 2 fitted inside the boundaries of the collar 1 and resting on and affixed to the shoulder roll 3 structure. The shoulder roll 3 and the anti-compression neck ring 2 and the collar 1 will be fully explained in FIG. 8.

Figure 6:
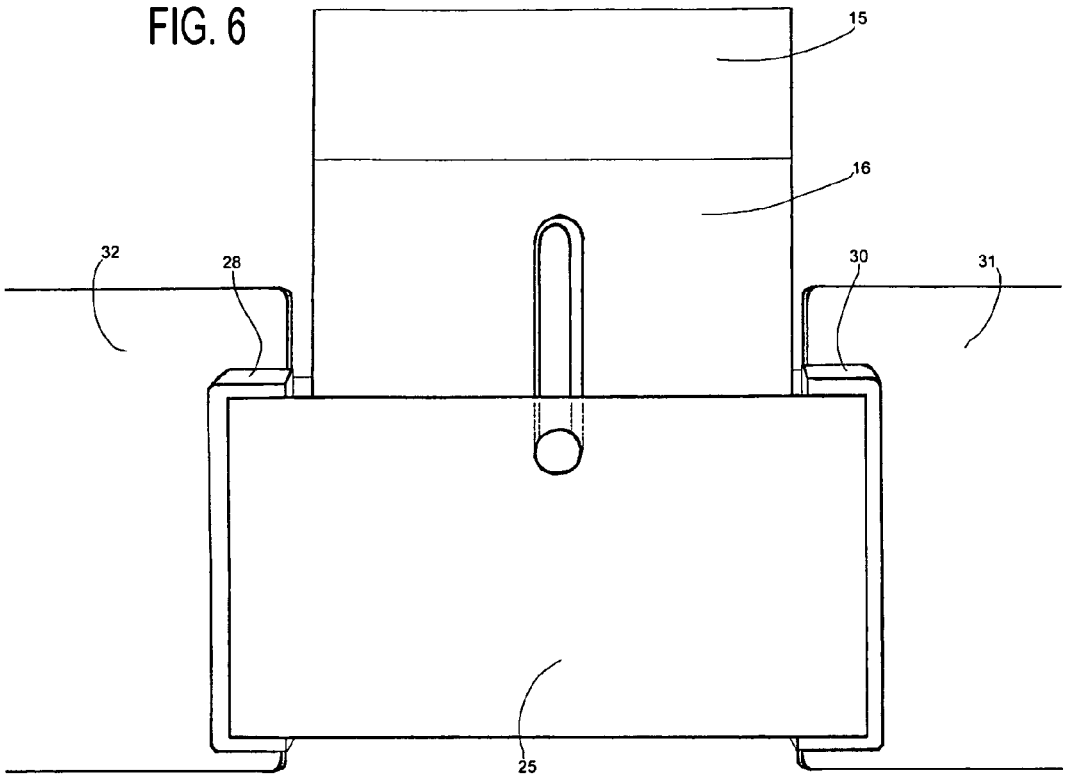
FIG. 6 shows the slide extender and holster unit fully extended.

FIG. 6 and FIG. 11 clearly shows the slide extender unit 15, 16, 25, visible and fully extended, also shown are the belt sections 31, 32, 28, 30 with 26, 24, 23 not visible in this angle, the slide extender can be constructed from a rigid material such as, but not limited to, PVC plastic. Where the slide extender holster is constructed of strong thin sheet metal panels 25, 26 and PVC sides, the slide extender unit allows the wearable spinal safety apparatus to grow naturally when wearer bends forward and will be a significant improvement in the art of a wearable spinal protection apparatus, providing comfort and protection, and is another preferred embodiment of this invention.

Figure 7:
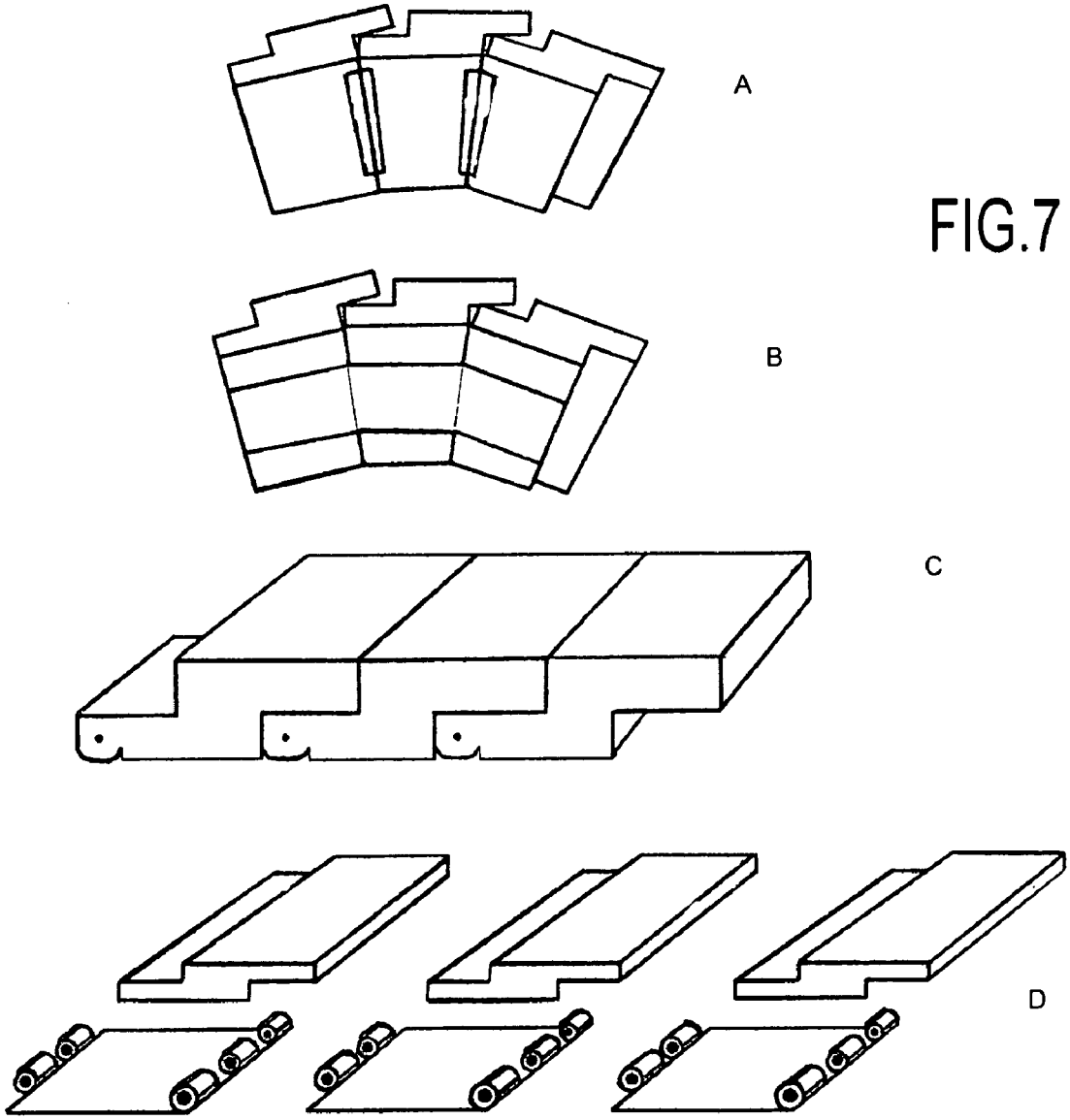
FIG. 7 shows four types of Zee-shingle arrangements that can make up the flexible beam.

FIG. 7 clearly shows another preferred embodiment of this invention, the 'Z'-shingle flexible beam in its many possible constructed arrangements. The 'Z'-shingle is a structure fashioned like a flattened letter Z and is made of a rigid material, usually, but not limited to plastic. It is molded or carved out or laminated into a single piece so that two levels are apparent, the bottom level extends in one direction the top level extends in the opposite direction, when 'Z'-shingle pieces are abutted against each other the top level of one will cover the bottom level of the next and so on, until a beam of any length is reached. The individual 'Z'-shingles are then bound together on the bottom or interior side, this continuous bonding together will allow the 'Z'-shingles to bend in relation to each other forming a contiguous curve of rigid material. The bonding can be accomplished in many ways, arrangement B shown from a angled bottom view, shows a strong fabric material with an adhesive that secures it to the rigid material used for the 'Z'-shingle, arrangement D shown by a exploded angled top view and displays another way to hold the 'Z'-shingles in this relationship, this method uses some form of mechanical hinge system, displayed is a ⅛ thick steel plated double ended 1 inch wide knuckled hinging panels that will form a contiguous metal foundation on which the 'Z'-shingles will be affixed. Arrangement A shown from a angled bottom view also shows a simple hinge could be used to bind the 'Z'-shingles together, arrangement C shown from a angled top view, shows yet another way is to build the hinge knuckles in to the bottom level of the 'Z'-shingle rigid material, the side of the 'Z'-shingle flexible beam that is bonded together will also be padded and be considered the inside surface of the wearable spinal protection apparatus. If a force is applied to the outside of this wearable spinal protection apparatus, the 'Z'-shingles will be placed in a mechanical bind forming a solid beam because the 'Z'-shingles are held firmly in this relationship by some bonding method, in this display by the metal hinge foundation structure. Also to increase the load bearing strength, a load tension strap 36, 37, 38 will support and span the distance between the upper shoulder roll anchorage 40 and the bottom hip slide extender anchorage 39, utilizing the same engineering principals of a support rope, the way it is used for a rope and plank bridge, and will be a significant improvement in the art of a wearable spinal protection apparatus.

FIG. 8 shows the shoulder roll 3 made from a rigid material, the shoulder roll closely curves over the shoulders nearest the neck of the wearer, the shoulder can be constructed by heat molding a rigid material such PVC plastic. The shoulder roll 3 serves to support the collar 1 and the anti-compression neck ring 2 and to anchor this apparatus and on which the 'Z'-shingle flexible beam is fastened and hung downward over the spinal column area. Also shown is the collar 1, which can be constructed by heat molding a rigid material such as PVC plastic. The spoon-like protrusions that flare outward are easily seen, these spoon like protrusions function to limit the motion of the helmet and therefore reduce whiplash injuries also to funnel or direct the helmet downward to meet the anti-compression neck ring, also shown is the anti-compression neck ring 2 fitted inside the boundaries of the collar 1 and resting on and affixed to the shoulder roll 3 structure. The anti-compression neck ring 2 can be constructed by heat molding a rigid material such PVC plastic, it will prevent the helmeted head from pushing down beyond the shoulder roll and will be a significant improvement in the art of a wearable spinal protection apparatus.

FIG. 9 is a exploded view of the spinal protection apparatus without the shoulder roll and without the slide holster and belt assembly, clearly shown here is the relative position of all its parts unassembled, the load tension strap 40, 37, 36, 35 39, 38 another preferred embodiment of this invention, is clearly displayed. The load tension strap is constructed of high strength flexible strapping material, usually but not limited to, a plastic fabric 37, 35, placed and centered over the lateral lumber joint bolt 34, 36 is a metal ring that connects the two halves of the strap 37, 35. In the center of the ring 36 is a centering clip 38, that will insure the ring is always over the lateral lumbar joint, the ends of the straps are held and anchored by a strap bar 40, 39, these bars are bolted in place at the upper and bottom anchorages. Also displayed in FIG. 9 is the lateral lumbar joint 9, 10, 11, 12, 13, 14, 21, 22, 34, another preferred embodiment of this invention, it is made of a rigid material, usually but not limited to, high strength plastic such as PVC. The actual dimensions can vary depending on the size of the wearer, the bottom layer has a rectangle approximately 5 inches by 2 inches in this displayed example, where one long side has a 15 degree isosceles triangle 13, 14, with a semi circle cut out at the vertex, two such pieces are arranged opposite each other vertex to vertex forming a hole in the center. In the center is placed a round plastic puck 12 that snugly fits in the cut out hole space, this arrangement is repeated in the second level 9, 11, 10, except the dimension are smaller to allow for the essential overhang of the top layers, both layers are then bolted on to the metal hinge panels, then the two triangular hinges 21, 22, are connected together by a joint bolt 34. This bolt travels through the hinge panels 21, 22 then through the two pucks 12, 11. This assemblage forms the lateral lumbar joint with a combined side to side travel of 30 degrees, although this travel distance can be adjusted to fit the wearer's needs and will be a significant improvement in the art of a wearable spinal protection apparatus.

Also displayed in FIG. 9 is the metal double ended hinge foundation 17, 18, 19, 20, 21, 22, 23, 24 that will support the 'Z'-shingle flexible beam presented here, other methods of bonding the interior side of the 'Z'-shingles would supplant this foundation displayed, such as but not limited to, wide high strength, metal or plastic or carbon strapping material or a fabric adhesive tape material such as industrial strength duct tape.

FIG. 11 is the slide extender unit 15, 16, 23, 24. Another preferred embodiment of this invention is the slide extender unit 25 which will allow the 'Z'-shingle flexible beam to elongate without loss of strength, protection or comfort to the wearer. The slide extender can be constructed from a rectangular rigid material such as PVC plastic; the actual dimensions can vary depending on the size of the wearer. The example displayed 16, is 5 inches by 6 inches, and has a 0.25 inch slot cut out of the center line that is 4 inches long, the metal hinge panel 24 matches 16 and will bolt to 16 with recessed nuts and bolts. Receiving the slide extender is the slide holster unit 25, 26, 30, 29, 28, 27, 33 the panels 25, 26 are made from strong thin sheet metal, which are fastened together on their sides by bolts which go through edge pieces 30, 29 on one side and 27, 28 on the opposite side. The belt halves are sandwiched in between 30, 29 on one side and 27, 28 on the opposite side, a bolt hole will be drilled on the center line of the metal plates 25, 26 to match where the top of the cut out slot in 16 in this hole will be placed a bolt 33 which will fasten the two parts together making them inseparable but allowing 16 to slide in and out, which will be a significant improvement in the art of a wearable spinal protection apparatus.

Figure 12:
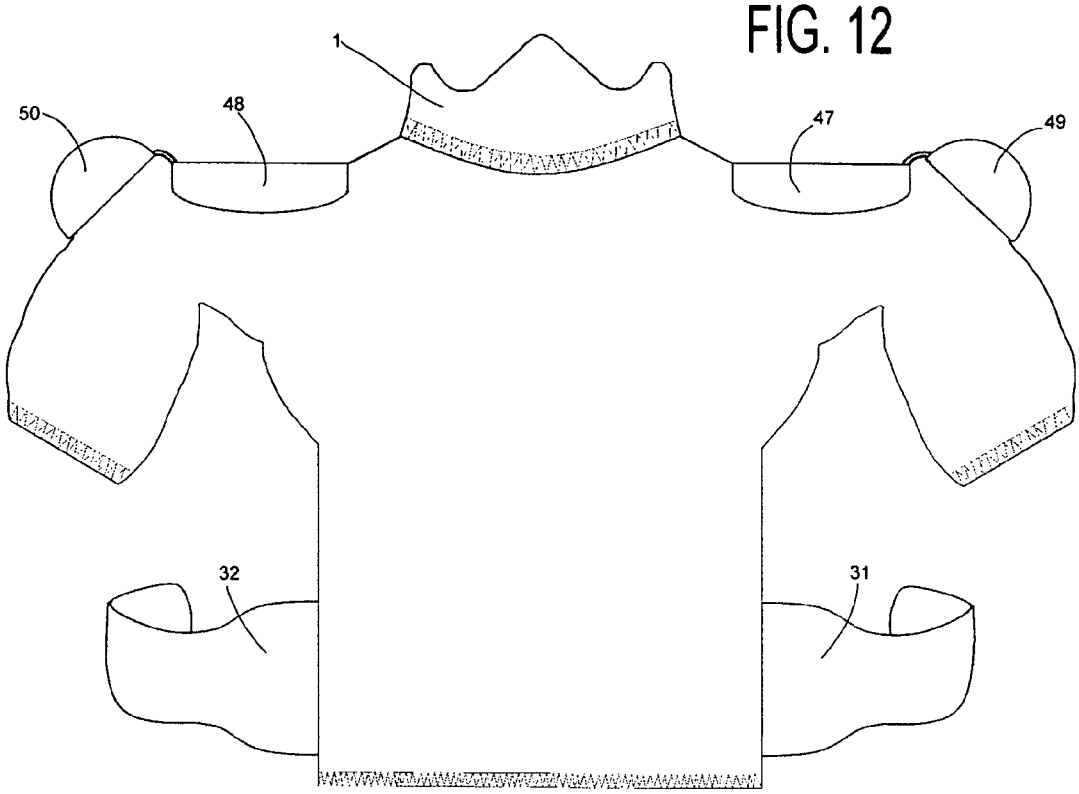
FIG. 12 shows the shirt garment which could be wrapped around this device

FIG. 12 this wearable spinal protection apparatus is shown in a rear view that shows the complete apparatus and some of its major components with shirt a garment; 1 is the helmet collar where the spoon like protrusions function to limit the motion of the helmet and therefore reduce whiplash injuries and 32, 31 are the hip belt sections these fit snugly around the hips of the wearer to anchor this safety apparatus at the base of the spinal column, 50, 48, 47, 49 are the shoulder protectors, these are made of rigid material and are attached to the shoulder roll 3, by soft strapping material and therefore float on the shoulders also they are attached to the shirt garment, The garment displayed is a shirt but it could also be a vest or even strapping if wearer desired.

FIG. 13 clearly shows is the lateral lumbar joint 9, 10, 11, 12, another preferred embodiment of this invention, it is made of a rigid material, usually but not limited to, high strength plastic such as PVC. The actual dimensions can vary depending on the size of the wearer and is more fully described in FIG. 9.

In view of the above descriptions of preferred embodiments of this invention, never seen before in prior art, it has been shown that the many advantages of the present invention of a wearable spinal protection apparatus have been achieved. As various changes could be made in the above examples of construction without departing from the scope of the invention, it is intended that all of the above descriptions of the preferred embodiment of this invention or shown in the accompanying drawings shall be interpreted as illustrative and not in a limiting sense. Accordingly, the drawings and description presented for this invention are intended to embrace all alternatives, modifications, and variations that fall within the spirit and scope of the of preferred embodiments.

What is claimed is:

1. A spinal protective apparatus for protecting the spine from neck to the lower back comprising:

a rigid collar adapted to receive a helmet defining a neck opening with three spaced apart raised sections;

a flat compression ring is secured on an inside edge of the rigid collar on which a bottom opening of the helmet is placed;

a rigid shoulder roll worn about the shoulders is attached to a lower surface of the flat compression ring;

the three spaced apart raised sections includes a central section that substantially extends further than the two on opposite sides thereof;

the three spaced apart raised sections and the flat compression ring prevents over extension of the neck from side to side when the helmet is donned;

a flexible shingle beam is attached to a central back portion of the rigid shoulder roll that substantially covers the back and the spine that bends forward but not backwards in order to prevent injury to the spine;

the flexible shingle beam is made of a plurality of Z-shaped segments connected to a plurality of hinges, respectively;

a load tension strap is secured to the shoulder roll and to a slide extender holster is substantially adjacent to the waist for forward bending;

one of the plurality of Z-shaped segments defines a lumbar lateral joint to allow side to side movement of the spine about the waist;

a padded hip belt assembly includes wide belt portions that are bolted to the slide extender holster and fastened about the hips.

2. The spinal protection apparatus of claim 1 comprises:

each of the plurality of Z-shaped segments has bottom and top outward extending portions that are abutted against respective bottom and top outward extending portions of adjacent Z-shaped segment forming the flexible shingle beam.

3. The spinal protection apparatus of claim 1 comprises:

the load tension strap is made of a high strength strapping material having anchor fasteners at opposite ends thereof.

4. The spinal protection apparatus of claim 1 comprises:

the lateral lumbar joint is made of two layers rigid material having substantial isosceles triangle configuration.

5. The spinal protection apparatus of claim 1 comprises:

the slide extender holster is made of two rigid sliding parts secured to the padded hip belt assembly to accommodate the spine bending and curving forward.

* * * * *